US009385462B2

(12) United States Patent
Li

(10) Patent No.: US 9,385,462 B2
(45) Date of Patent: Jul. 5, 2016

(54) CARD EDGE CONNECTOR HAVING IMPROVED TERMINALS

(71) Applicant: FOXCONN INTERCONNECT TECHNOLOGY LIMITED, Grand Cayman (KY)

(72) Inventor: Zhuang-Xing Li, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/698,727

(22) Filed: Apr. 28, 2015

(65) Prior Publication Data

US 2015/0311611 A1 Oct. 29, 2015

(30) Foreign Application Priority Data

Apr. 28, 2014 (CN) ..... 2014 1 0172929

(51) Int. Cl.
*H01R 24/00* (2011.01)
*H01R 13/41* (2006.01)
*H01R 12/72* (2011.01)

(52) U.S. Cl.
CPC ..... *H01R 13/41* (2013.01); *H01R 12/722* (2013.01)

(58) Field of Classification Search
CPC .... H01R 13/41; H01R 12/722; H01R 12/721; H01R 12/725; H01R 12/89
See application file for complete search history.

(56) References Cited

U.S. PATENT DOCUMENTS 5,984,698 A * 11/1999 Hirata ..... H01R 12/725 439/101
6,315,616 B1 * 11/2001 Hayashi ..... H01R 12/89 439/108
6,561,849 B2 * 5/2003 Naito ..... H01R 23/6873 439/607.4
7,029,330 B1 4/2006 Ro
7,320,623 B2 * 1/2008 Hisamatsu ..... H01R 12/721 439/108

* cited by examiner

*Primary Examiner* — Jean F Duverne
(74) *Attorney, Agent, or Firm* — Wei Te Chung; Ming Chieh Chang

(57) ABSTRACT

A card edge connector is used for connecting an electronic card to a printed circuit board and includes an insulative housing defining a central slot extending along a longitudinal direction with a key disposed therein and a plurality of terminal slots located on at least one side of the central slot; and a plurality of conductive terminals received in the terminal slots and each defining a retaining portion retained in the insulative housing, a contacting portion extending into the central slot along a mating direction perpendicular to the longitudinal direction and a soldering portion extending outside of the insulative housing. The retaining portion of each conductive terminal defines a pair of positioning portions interfering with the insulative housing in the longitudinal direction, and each positioning portion defines an inclined portion guiding the conductive terminal inserted into the insulative housing along the mating direction.

9 Claims, 6 Drawing Sheets

CARD EDGE CONNECTOR HAVING IMPROVED TERMINALS

BACKGROUND OF THE INVENTION

1. Field of the Invention

The present invention relates to a card edge connector, and more particularly to a card edge connector having improved terminals which are conducive to the card edge connector mounted on a printed circuit board. This invention relates to the copending application Ser. No. 14/257,960 filed Feb. 21, 2014.

2. Description of the Related Art

The card edge connector is widely used in computer device for receiving an electronic card. A common card edge connector generally includes a longitudinal insulative housing, a plurality of conductive terminals fixed in the insulative housing and a retention member fixed to the insulative housing and secured to a printed circuit board. The insulative housing defines a central slot extending along a longitudinal direction for the electronic card inserted. The conductive terminals are located on both sides of the central slot and extending into the central slot to grip the electronic card, whereby the fingers on the electronic card can be stably electrically connected. However, as the transmission rate of electronic card higher, the number of conductive terminals and fingers of electronic card is also increased accordingly, the wall thickness of the insulative housing between the adjacent conductive terminals is relatively reduced in a limited space, which may cause the strength between the conductive terminals and the insulative housing reduced. The conductive terminal is easy detachment from the insulative housing by a larger impact force, thus affecting the electrical transmission of the card edge connector.

Therefore, an improved card edge connector is highly desired to meet overcome the requirement.

BRIEF SUMMARY OF THE INVENTION

An object of the present invention is to provide a card edge connector, which makes a plurality of conductive terminals exactly and stability retained in an insulative housing.

In order to achieve above-mentioned object, a card edge connector used for connecting an electronic card to a printed circuit board and includes an insulative housing defining a central slot extending along a longitudinal direction with a key disposed therein and a plurality of terminal slots located on at least one side of the central slot; and a plurality of conductive terminals received in the terminal slots and each defining a retaining portion retained in the insulative housing, a contacting portion extending into the central slot along a mating direction perpendicular to the longitudinal direction and a soldering portion extending outside of the insulative housing. The retaining portion of each conductive terminal defines a pair of positioning portions interfering with the insulative housing in the longitudinal direction, and each positioning portion defines an inclined portion guiding the conductive terminal inserted into the insulative housing along the mating direction.

Other objects, advantages and novel features of the invention will become more apparent from the following detailed description of the present embodiment when taken in conjunction with the accompanying drawings.

DESCRIPTION OF PREFERRED EMBODIMENT OF THE INVENTION

Figure 1:
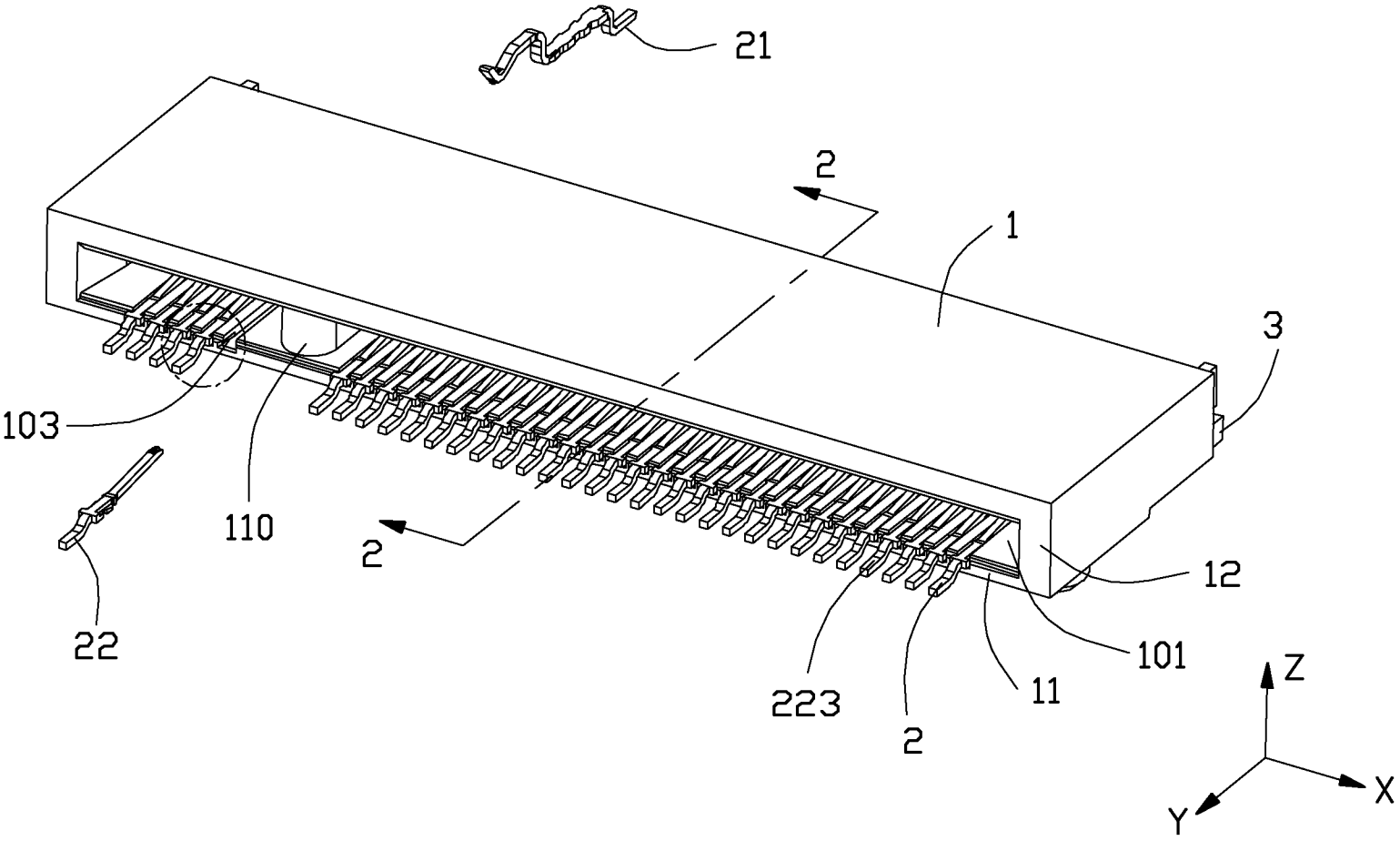
FIG. 1 is a perspective view of a card edge connector in accordance with the present invention.
Figure 2:
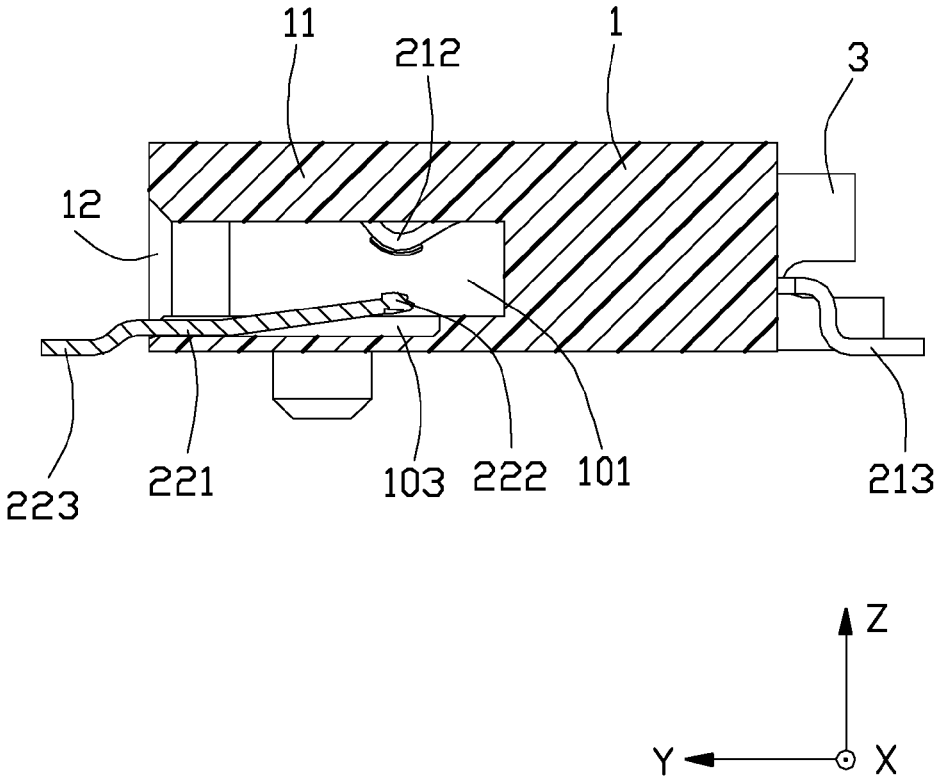
FIG. 2 is a cross-section view of the card edge connector taken along line 2-2 of FIG. 1.
Figure 3:
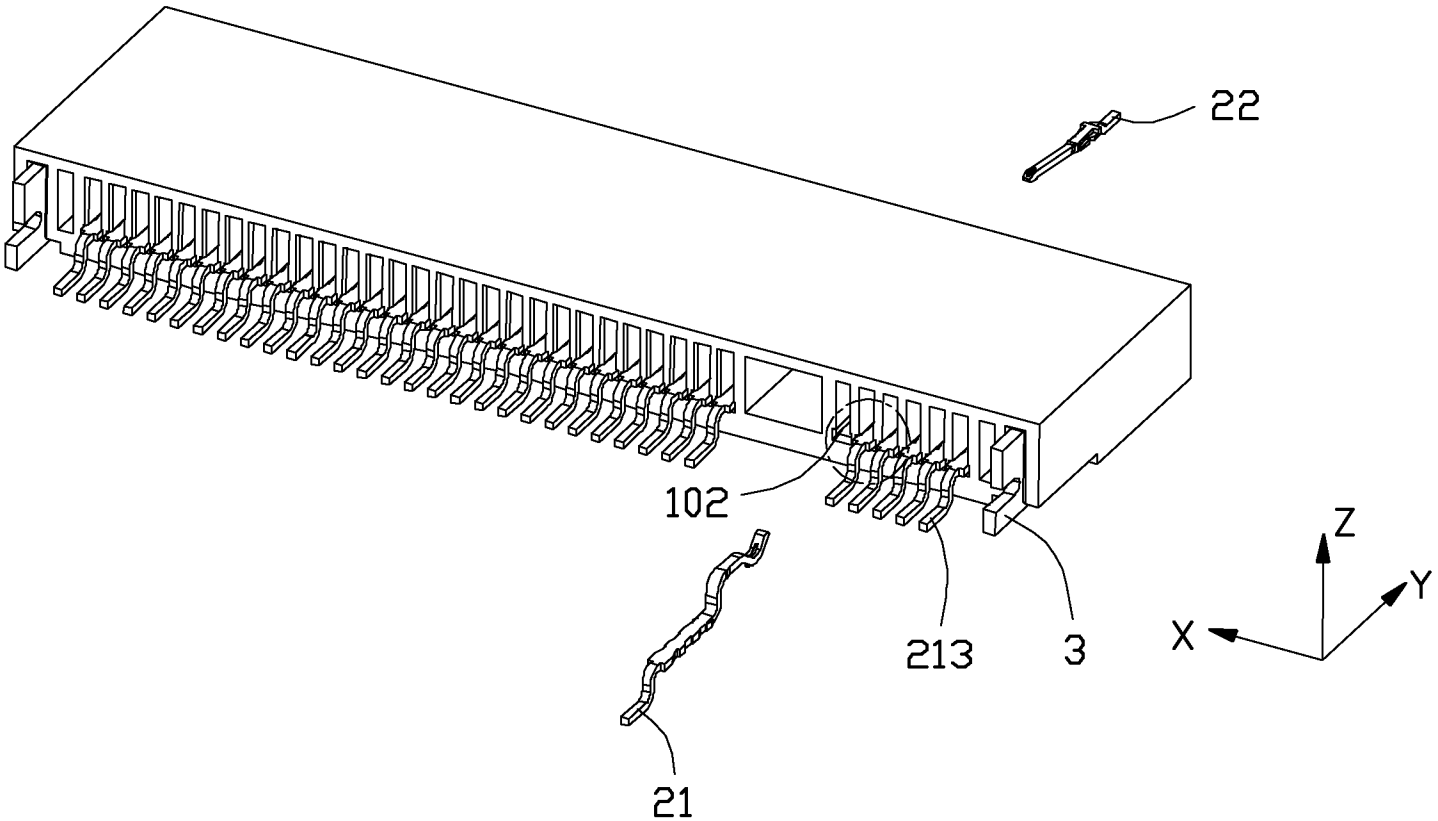
FIG. 3 is another perspective view of the card edge connector shown in FIG. 1.

Reference will now be made to the drawing figures to describe a preferred embodiment of the present invention in detail. Referring to FIG. 1 to FIG. 3, a card edge connector 100 in accordance with the present invention is used for connecting an electronic card to a printed circuit board. The card edge connector 100 includes a longitudinal insulative housing 1, a plurality of conductive terminals 2 retained in the insulative housing 1 and at least one retention members 3 fixed to the insulative housing 1 and soldered on the printed circuit board.

The insulative housing 1 defines two sidewalls 11 extending along a longitudinal direction, i.e., X direction, and two end walls 12 connecting two sidewalls 11, whereby the insulative housing 1 forms a central or mating slot 101 extending along the longitudinal direction for receiving the electronic card. The insulative housing 1 defines a key 110 disposed in the central slot 101 to prevent an incorrect electronic card inserted into the card edge connector and a plurality of first terminal slots 102 and second terminal slots 103 communicating with the central slot 101 and receiving the conductive terminals 2.

The conductive terminals 2 are located on both sides of the central slot 101 and include a plurality of first terminals 21 inserted into the insulative housing 1 along a mating direction, i.e., Y direction, perpendicular to the longitudinal direction and a plurality of second terminals 22 inserted into the insulative housing 1 along a direction opposite to the insertion direction of the first terminals 21. Each first terminal 21 defines a first retaining portion 211 fixed in the insulative housing 1, a first contacting portion 212 extending into the central slot 101 from the first retaining portion 211 and a first soldering portion 213 extending outside of the insulative housing 1 from the first retaining portion 211. The structure of second terminal 22 is similar to the structure of first terminal 21 and each second terminal 22 defines a second retaining portion 221, a second contacting portion 222 and a second soldering portion 223. The first and second contacting portions 211, 221 are disposed on opposite sides of the central slot 101 in a vertical direction, i.e., Z direction, perpendicular to the longitudinal direction and the mating direction and contacting the opposite sides of the electronic card, respectively. The soldering portions of the first and second terminals are located on both sides of the insulative housing 1 in the mating direction, which can reduce the area occupied on the printed circuit board.

Figure 4:
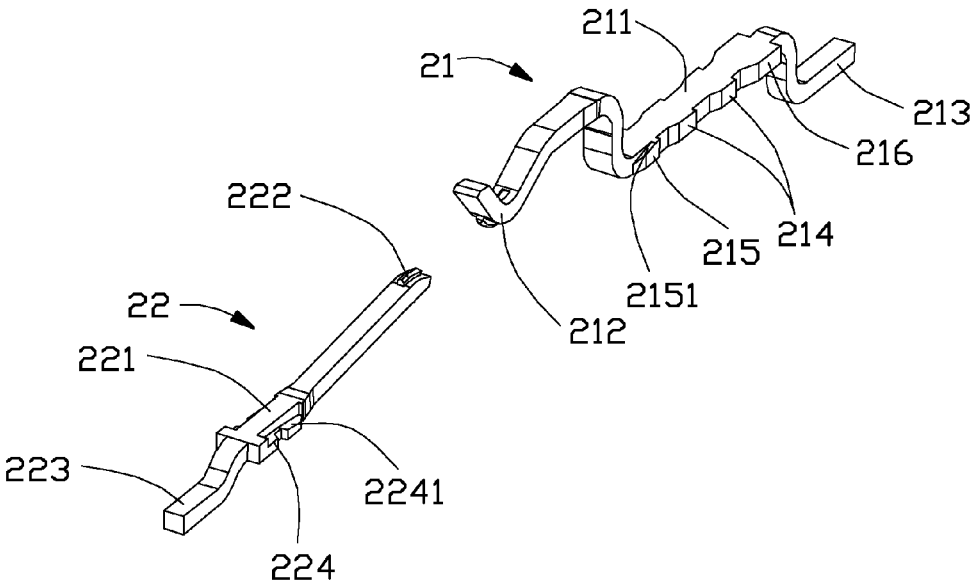
FIG. 4 is a perspective view of a pair of conductive terminals of the card edge connector shown in FIG. 1.
Figure 5:
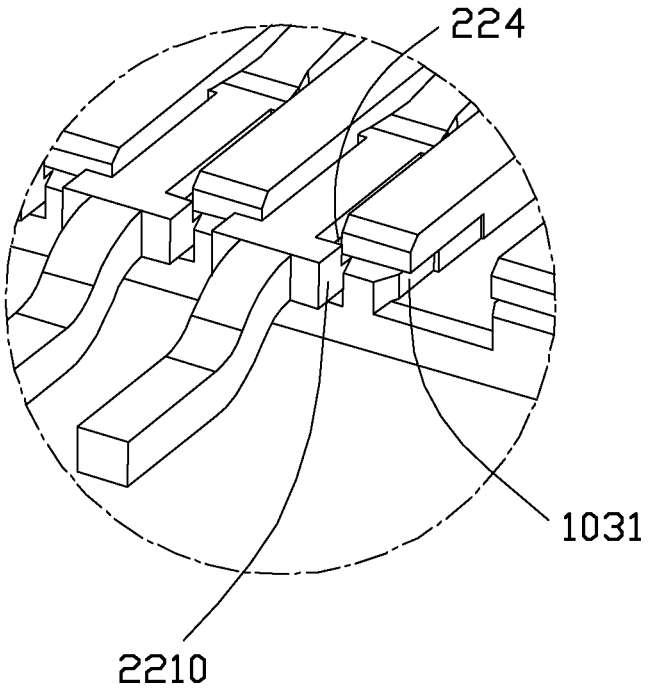
FIG. 5 is an enlarged perspective view of a part of the card edge connector shown in FIG. 1.
Figure 6:
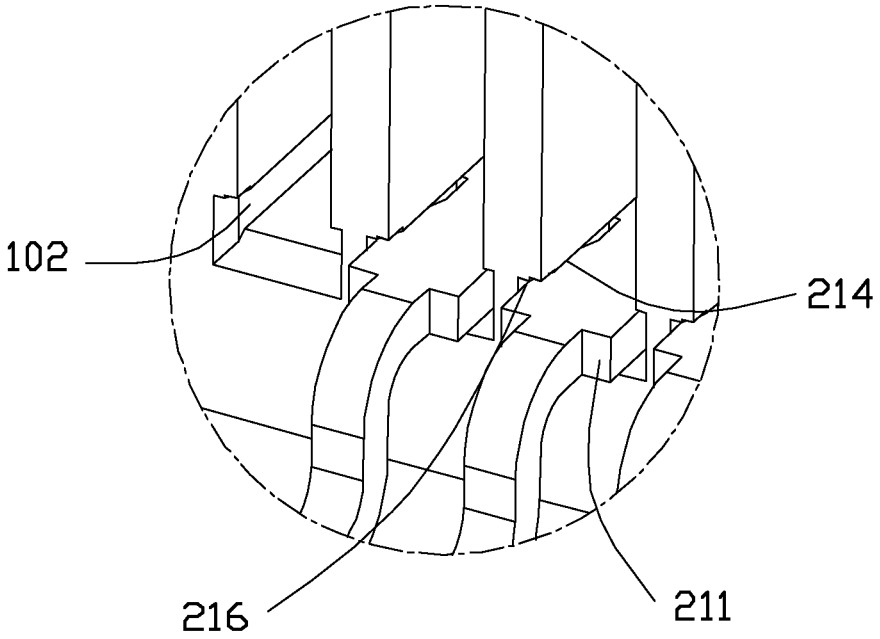
FIG. 6 is an enlarged perspective view of a part of the card edge connector shown in FIG. 3.

Referring to FIG. 4 to FIG. 6, the first retaining portion 211 of the first terminal 21 defines a stopper portion 214 retained in the first terminal slot 102 of the insulative housing 1 and limited by the insulative housing 1 in the vertical direction, a first positioning portion 215 and a second positioning portion 216 disposed at a position adjacent to the stopper portion 214 and interfering with the insulative housing 1. Notably, all the stopper portion 214, the first positioning portion 215 and the second positioning portion 216 are deemed as the barbs performing the interference function. When the first terminal 21 is inserted into the first terminal slot 102, the barb of the first positioning portion 215 punctures the both sides of the first terminal slot 102 so as to interfere with the insulative housing 1 and move on. Also, each first positioning portion 215 defines an inclined portion 2151 extruding the insulative housing 1, the reaction force on the inclined portion 2151 pressed by the insulative housing 1 makes the first terminal 21 close to the lower side of the first terminal slot 102, which is conducive to guide the first terminal inserted smoothly and exactly. The stopper portion 214 ensures the first terminal inserted in the predetermined direction accurately without traverse occurred, the second positioning portion 216 also defines a pair of barbs interfering with the insulative housing 1, which is conducive to the first terminal 21 fixed to the insulative housing 1 stability. In present embodiment, the stopper portion 214 has a low interference force or non-interference with the insulative housing 1, thereby reduce relatively the insertion resistance of the first terminal 21.

The second retaining portion 221 of the second terminal 22 defines a base portion 2210 and a third positioning portion 224 thinner than the base portion 2210 and interfering with the insulative housing 1, thereby the second retaining portion 221 is stepped shape so as to make the second terminal 21 fixed stability and reduce the damage to the insulative housing 1. When the second terminal 22 is inserted into the second terminal slot 103, the barb of the third positioning portion 224 punctures the both sides of the second terminal slot 103 so as to interfere with the insulative housing 1 and move on. The third positioning portion 224 defines an inclined portion 2241 extruding the insulative housing 1, the reaction force on the inclined portion 2241 pressed by the insulative housing 1 makes the second terminal 22 close to the lower side of the second terminal slot 103, which is conducive to guide the second terminal inserted smoothly and exactly. Correspondingly, the end wall 1031 of second terminal slot 103 is stepped shape and used for mating the stepped second retaining portion 221, it is conducive to reduce the thickness of the card edge connector to reduce the thickness of the third positioning portion 224.

Thus, it makes the first and second terminals inserted exactly and stability with guided by the inclined portions of the first and second terminals, and the segmented structure of the first retaining portion 211 is conducive to the first terminal 21 fixed stability and reduce relatively the insertion resistance.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the board general meaning of the terms in which the appended claims are expressed.

What is claimed is:

1. A card edge connector, used for connecting an electronic card to a printed circuit board and comprising:

an insulative housing defining a central slot extending along a longitudinal direction with a key disposed therein and a plurality of terminal slots located on at least one side of the central slot; and a plurality of conductive terminals received in the terminal slots and each defining a retaining portion retained in the insulative housing, a contacting portion extending into the central slot along a mating direction perpendicular to the longitudinal direction and a soldering portion extending outside of the insulative housing; wherein the retaining portion of each conductive terminal defines a pair of positioning portions interfering with the insulative housing in the longitudinal direction, and each positioning portion defines an inclined portion guiding the conductive terminal to be inserted into the insulative housing along the mating direction; wherein the retaining portion of the conductive terminal also defines a pair of stopper portions received in the terminal slot and disposed at a position adjacent to the positioning portions; wherein the stopper portion is limited by the insulative housing in a vertical direction perpendicular to both the longitudinal direction and the mating direction; wherein the stopper portion combine to the insulative housing with a lower interference force or non-interference force; wherein the conductive terminals are located on both sides of the central slot and include a plurality of first terminals inserted into the insulative housing along the mating direction and a plurality of second terminals inserted into the insulative housing along a direction opposite to the insertion direction of the first terminals;

wherein the retaining portion of the second terminal defines a base portion and a pair of third positioning portions disposed at both sides of the base portion in the longitudinal direction and being thinner than the base portion in the vertical direction;

wherein the third positioning portions of the second terminal mate with the insulative housing in a interfering manner.

2. The card edge connector as described in claim 1, wherein the positioning portions include a pair of first positioning portions and a pair of second positioning portions located at opposite side of the first positioning portions related to the stopper portions in the mating direction, each of the first and second positioning portions defines a barb interfering with the insulative housing.

3. The card edge connector as described in claim 1, wherein each of the terminal slots of the insulative housing corresponding to the second terminal defines a stepped end wall used for abutting the corresponding second retaining portion of the second terminal.

4. A card edge connector, used for connecting an electronic card to a printed circuit board and comprising:

an insulative housing defining a central slot extending along a longitudinal direction, a plurality of first and second terminal slots located in opposite sides of the central slot and communicating with the central slot in a vertical direction perpendicular to said longitudinal direction;

a plurality of first terminals retained in the first terminal slots, each of said first terminals defining a first retaining portion fixed in the insulative housing, a first contacting portion obliquely extending into the central slot and a first soldering portion extending out of the insulative housing; and a plurality of second terminals retained in the second terminal slots, each of said second terminals defining a second retaining portion fixed in the insulative housing, a second contacting portion upwardly and obliquely extending from the retaining portion into the central slot, and a second soldering portion extending out of the insulative housing; wherein each of the first and second retaining portions defines a pair of positioning portions interfering with the insulative housing in the longitudinal direction and being thinner than main part of the corresponding first and second retaining portion in the vertical direction, and each positioning portion defines an inclined portion adjacent to the corresponding first and second contacting portion so as to guide the conductive terminal to be inserted into the insulative housing easily along the mating direction; wherein each of said first retaining portions also defines a pair of stopper portions received in the terminal slot, and the positioning portions define a pair of first positioning portions and a pair of second positioning portions disposed adjacent to the stopper portions in a mating direction perpendicular to the longitudinal direction; wherein the stopper portion is limited by the insulative housing in a vertical direction perpendicular to both the longitudinal direction and the mating direction and combine to the insulative housing with a lower interference force or non-interference force.

5. The card edge connector as described in claim 4, wherein the second retaining portion defines a base portion adjacent to the second soldering portion and being thicker than the positioning portion of the second retaining portion in the vertical direction, the second terminal slots defines a stepped end wall used for abutting the corresponding second retaining portion of the second terminal.

6. An electrical connector comprising:

an insulative housing defining a mating slot and at least one terminal slot communicating with said mating slot, said terminal slot extending along a front-to-back direction, and forming, on two opposite lateral sides along a transverese direction perpendicular to said front-to-back direction, a pair of step structures in a vertical direction perpendicular to both said front-to-back direction and said transverse direction;

at least one terminal disposed within the housing and forming a contacting section exposed within the mating slot, a tail section exposed outside of the housing for mounting upon a printed circuit board, and a retaining section located between said contacting section and said tail section in the front-to-back direction, said retaining section further including a front pair of barb structures and rear pair of barb structures spaced from each other in the front-to-back direction and both located under said step structures; wherein each of the front pair of barb structures is equipped with a forwardly wedged structure along the front-to-back direction to form a guiding surface thereof for easing insertion of the terminal into the terminal slot wherein the barb structures are thinner than remaining portions of the retaining section in the vertical direction; wherein each of the rear pair of barb structures is equipped with a stopper so as to prevent the terminal from further insertion into the terminal slot; wherein said terminal is rearwardly inserted into the terminal slot along said front-to-back direction.

7. The electrical connector as claimed in claim 6, wherein said pair of step structures are located around a rear end of the terminal slot exposed to an exterior.

8. The electrical connector as claimed in claim 7, wherein on each said step structures, another step structure is formed along a front-to-back direction so as to comply with an lateral expanded portion of the barb structure.

9. The electrical connector as claimed in claim 8, wherein said another step structure forms two steps thereon to comply with the front pair of barb structures and the rear pair of barb structures.

* * * * *